United States Patent [19]

van Brummelen

[11] 4,257,141

[45] Mar. 24, 1981

[54] DEVICE FOR MODELLING OR PACKING AN OBJECT

[75] Inventor: Johannes van Brummelen, Barneveld, Netherlands

[73] Assignee: Moba Holding Barneveld B.V., Barneveld, Netherlands

[21] Appl. No.: 964,348

[22] Filed: Nov. 28, 1978

[30] Foreign Application Priority Data

Dec. 9, 1977 [NL] Netherlands ..... 7713639

[51] Int. Cl.³ ..... A22C 21/00

[52] U.S. Cl. ..... 17/11; 53/529

[58] Field of Search ..... 17/11, 49; 53/523, 529; 83/388, 389, 390, 422

[56] References Cited

U.S. PATENT DOCUMENTS

| | | | |
|---|---|---|---|
| 2,560,067 | 7/1951 | Bell | 17/11 |
| 3,817,167 | 6/1974 | Mosterd | 17/11 X |
| 3,864,787 | 2/1975 | Mosterd | 17/11 |
| 4,121,321 | 10/1978 | Mosterd | 17/11 |

*Primary Examiner*—Willie G. Abercrombie

[57] ABSTRACT

A device for modelling and packing of an object, the device having a container adapted to be closed to enclose the object and driving means for the closing movement of the container, and wherein the driving means contains elastic elements which permit the container to close less than completely if the object is too big.

12 Claims, 13 Drawing Figures

DEVICE FOR MODELLING OR PACKING AN OBJECT

The invention relates to a device for modelling or packing an object provided with a container that can be closed around the object, driving means for the container to move it from a first position, in which it has a first circumferential shape, towards a second position in which it has a second circumferential shape, the second circumferential shape having a smaller cross-sectional area than the first one.

Such a device for modelling poultry is known from the Dutch Patent Application No. 76.03625.

A difficulty with such devices is that if the objects have different shapes or dimensions, as may be the case with poultry, it is possible that an object is too bulky to allow the container to close. If this occurs the possibility exists of interference with the operation of the device and even damage is possible as well as jamming of the device in the container or damage of the object itself.

The invention aims to provide an efficient solution with which it is possible to eliminate these draw-backs. More specifically the prevention of these draw-backs makes it possible to have a small tolerance of the circumferential shape of the container with respect to most of the objects, by reason of which better modelling or a tighter packing of the average object is possible.

According to the invention the above draw-backs are eliminated and the advantages resulting from the elimination thereof are obtained by providing the driving means with elastic elements which allow the container to close less than completely.

When applying the invention consequently if the container cannot completely close nothing is forced. In connection therewith it is often desirable that if the container is not completely closed the objects contained therein are carried off in a way differing from the normal procedure for handling the objects.

A solution for this consists in that a special discharge means for the container are present which are controlled by the container such that they are activated if the container is not in its completely closed position.

An important application of the invention is the case in which the container is a modelling tube for poultry, which tube can be opened and closed. Herewith especially differences in dimensions occur and good modelling and packing of a good model is of great importance.

An embodiment of the invention, with which good experimental results have been obtained, consists in that an endless track is present along with means for moving the device along said track, control guides being arranged along said track which, together with follower members mounted on the device, are the driving means for the container.

However it is also possible to apply the invention with devices which are non-movably mounted.

Further features and details will be explained with reference to the drawing in which.

Figure 3:
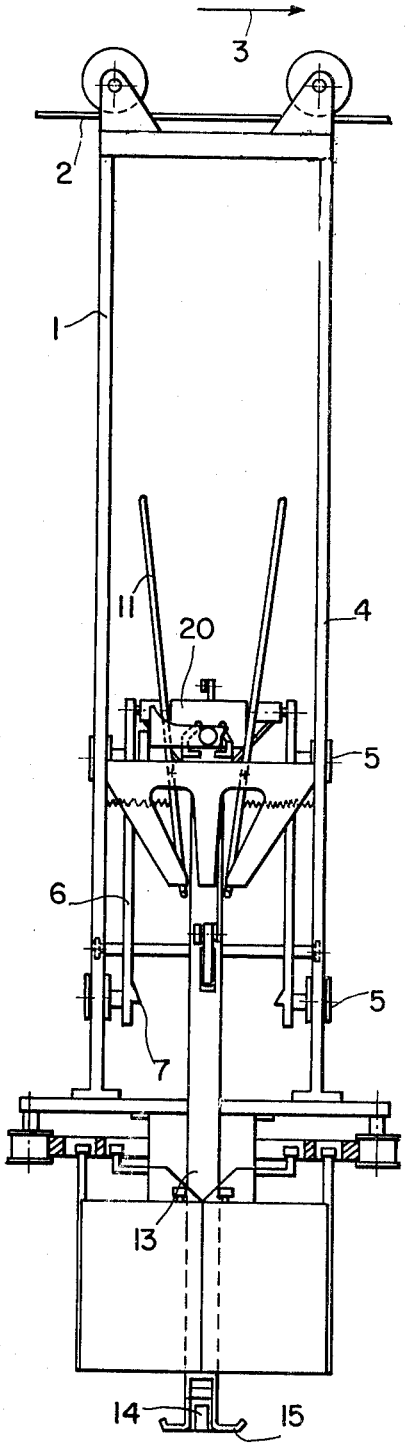
Figure 1:
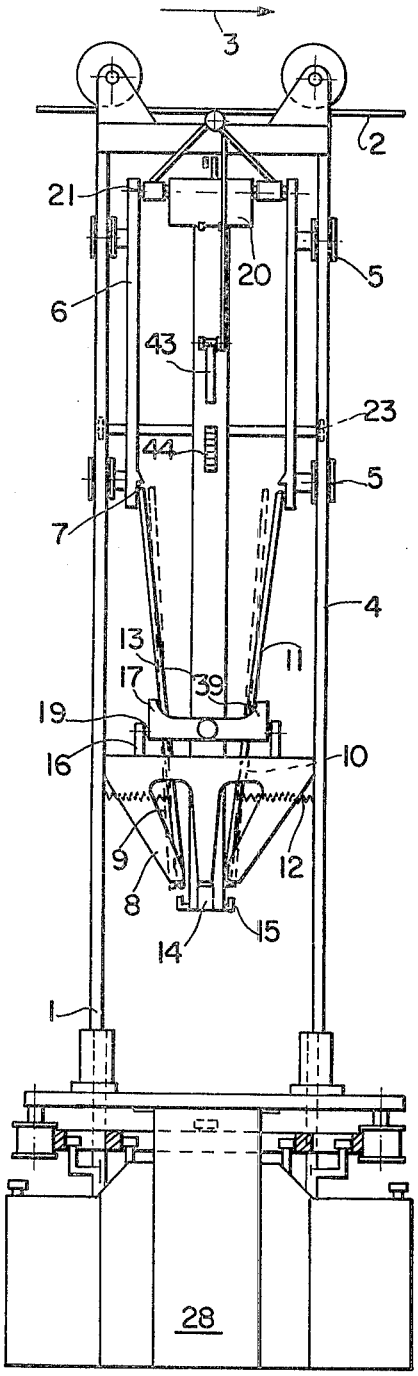
FIG. 1 is a front view of the device according to the invention in the starting position.
Figure 2:
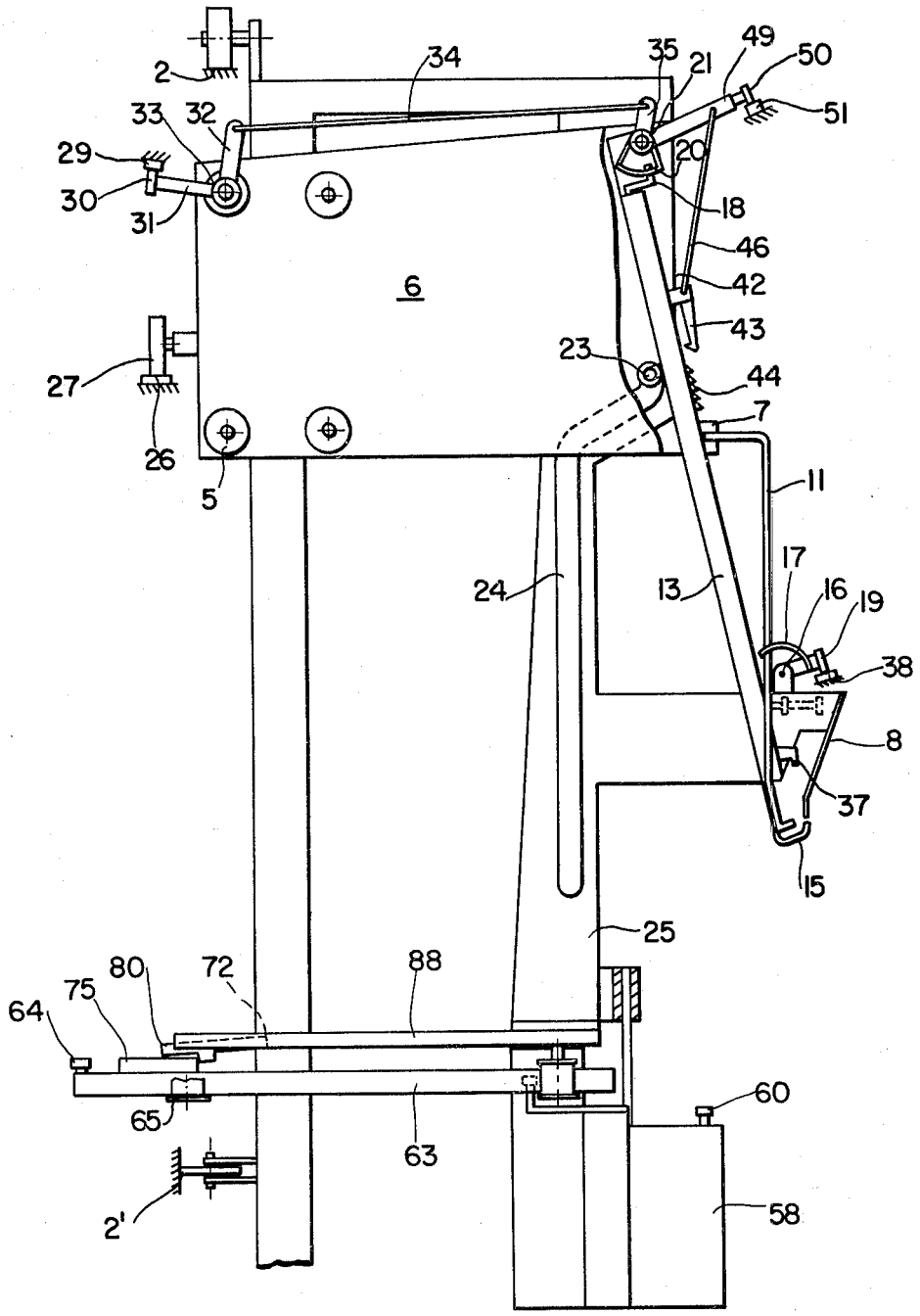
FIG. 2 is a side view of FIG. 1.
Figure 4:
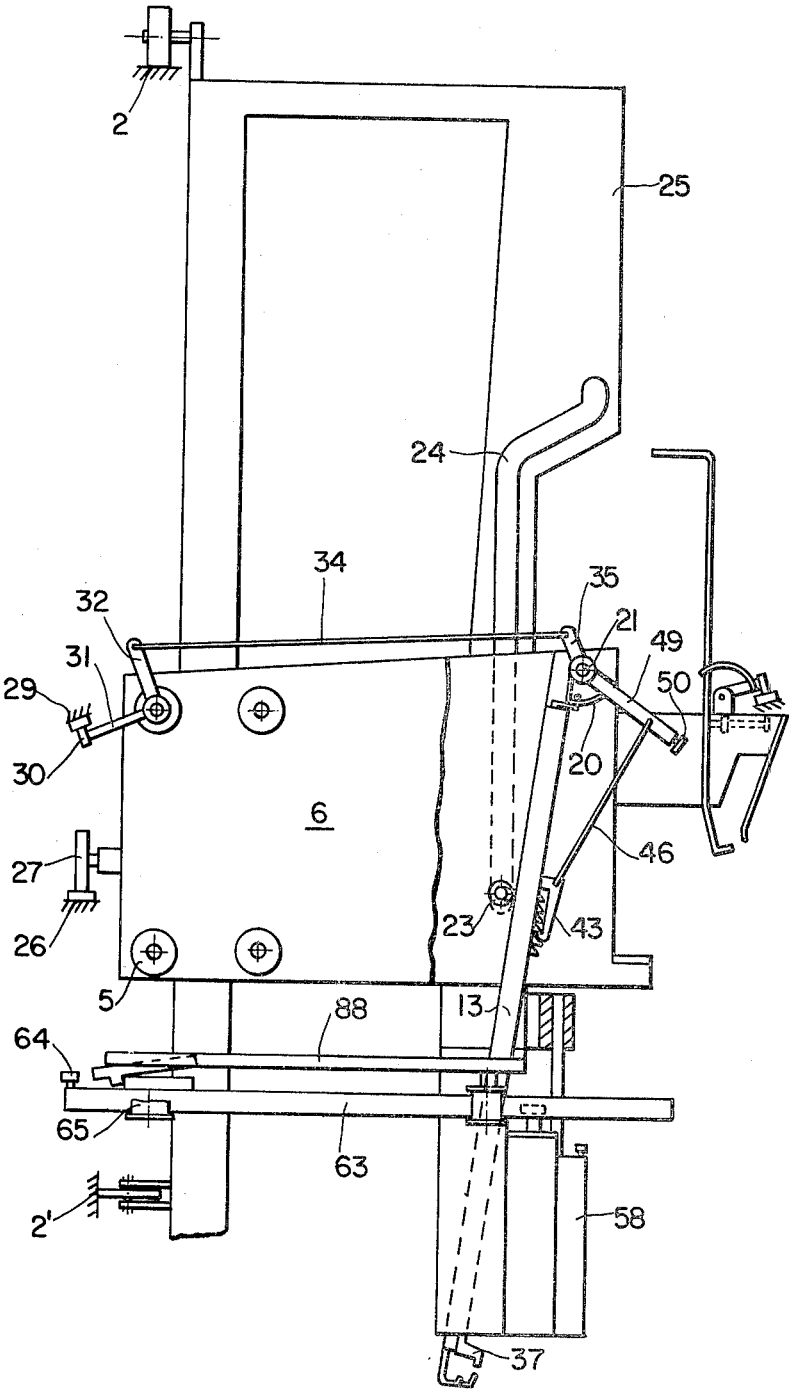
Figure 5:
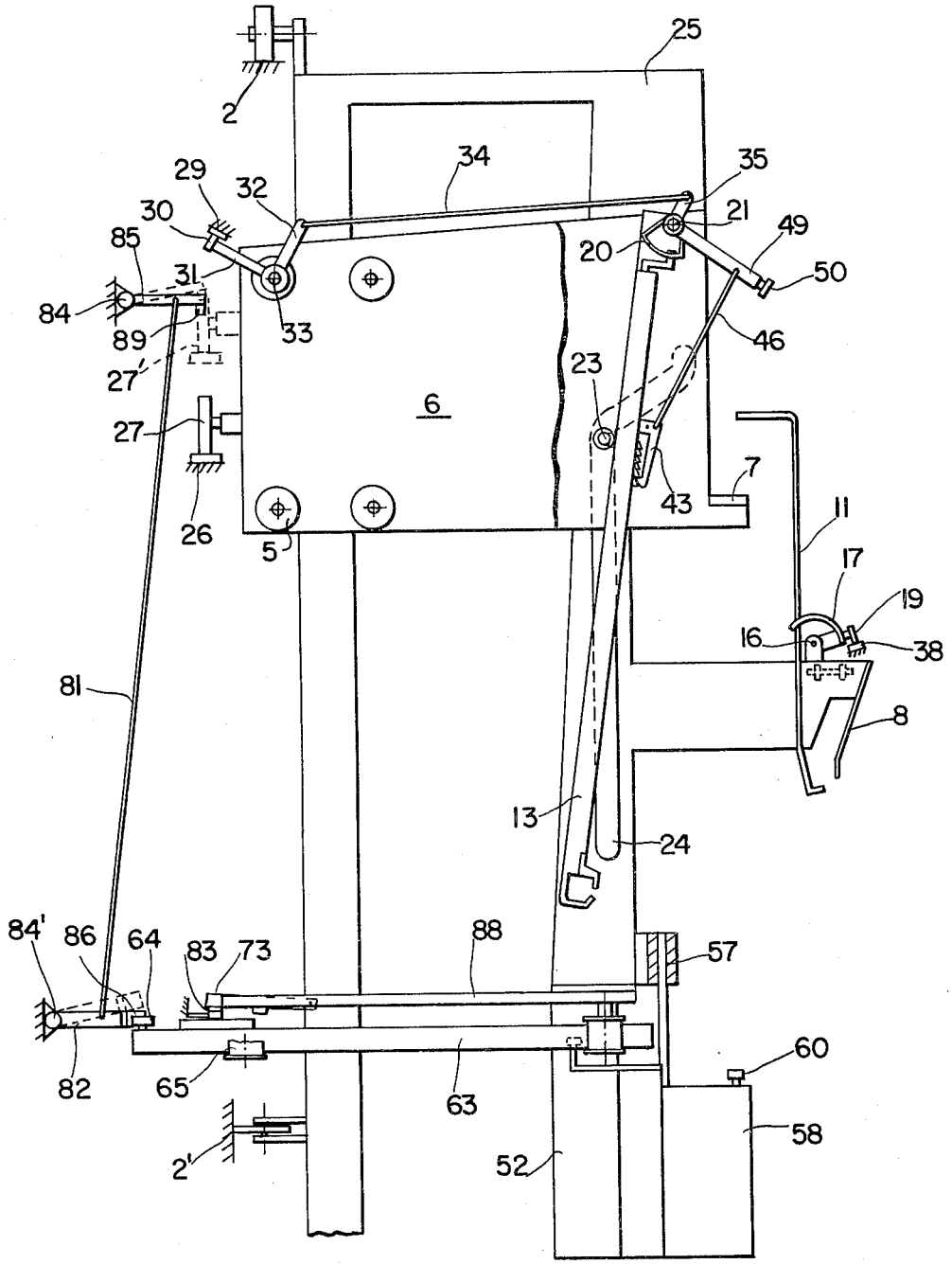
Figure 6:
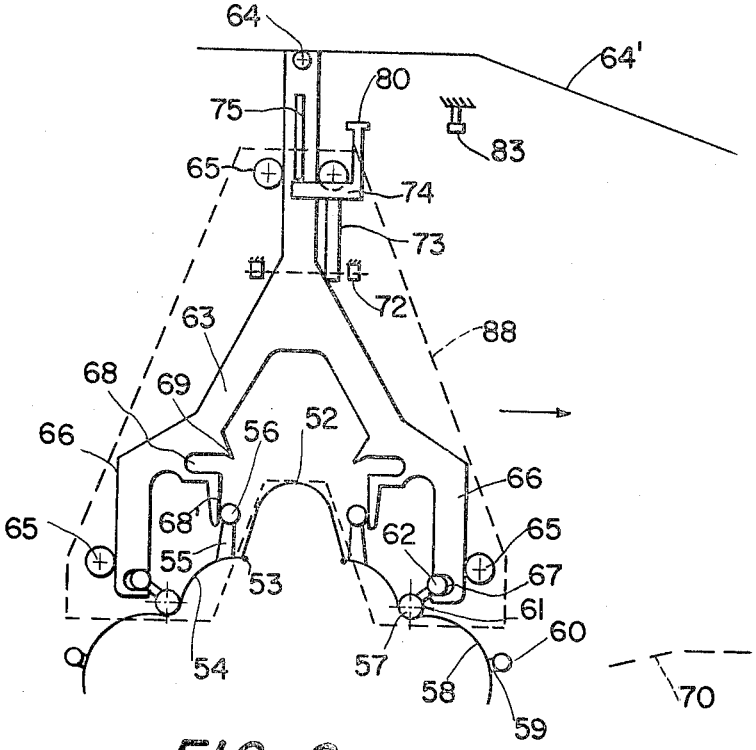
Figure 7:
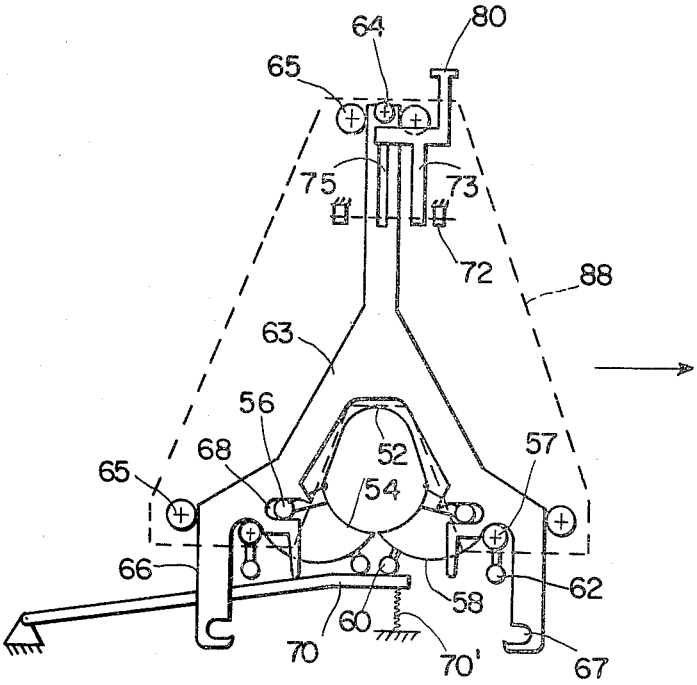
Figure 8:
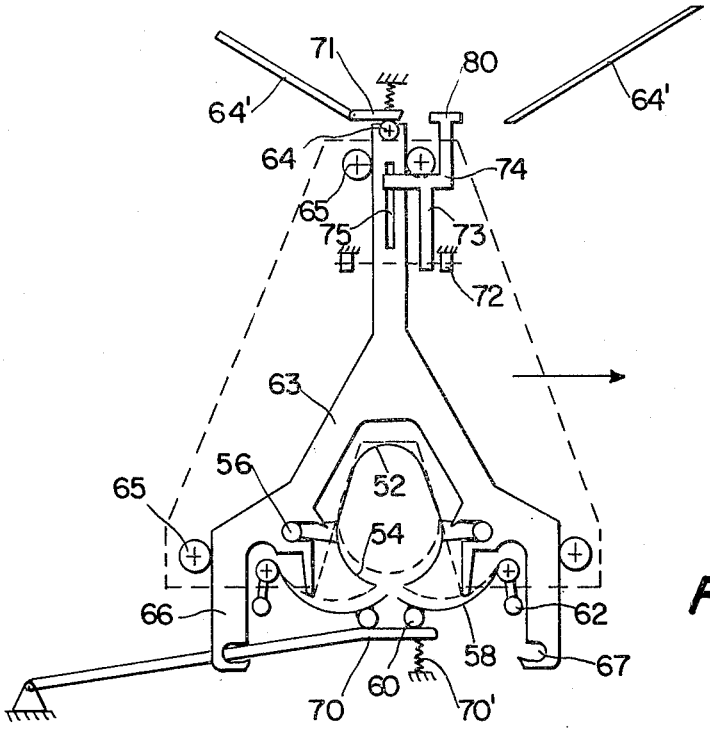
Figure 10:
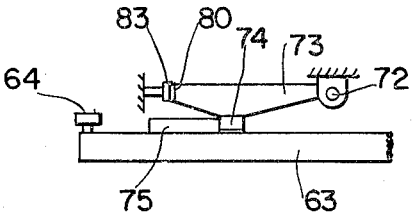
Figure 11:
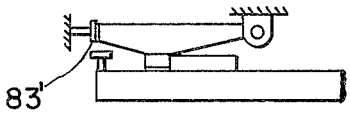
Figure 12:
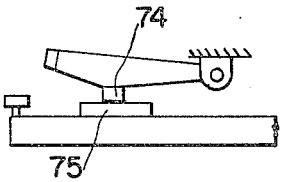
Figure 9:
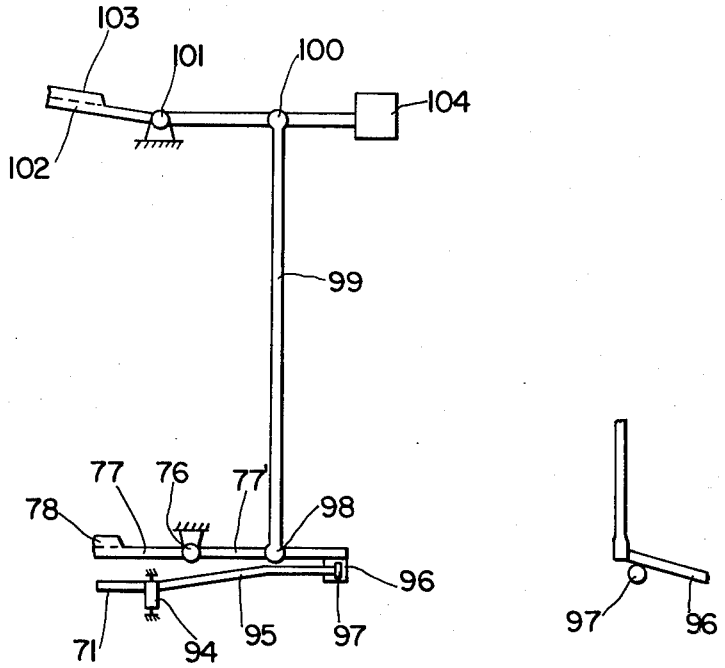
Figure 13:
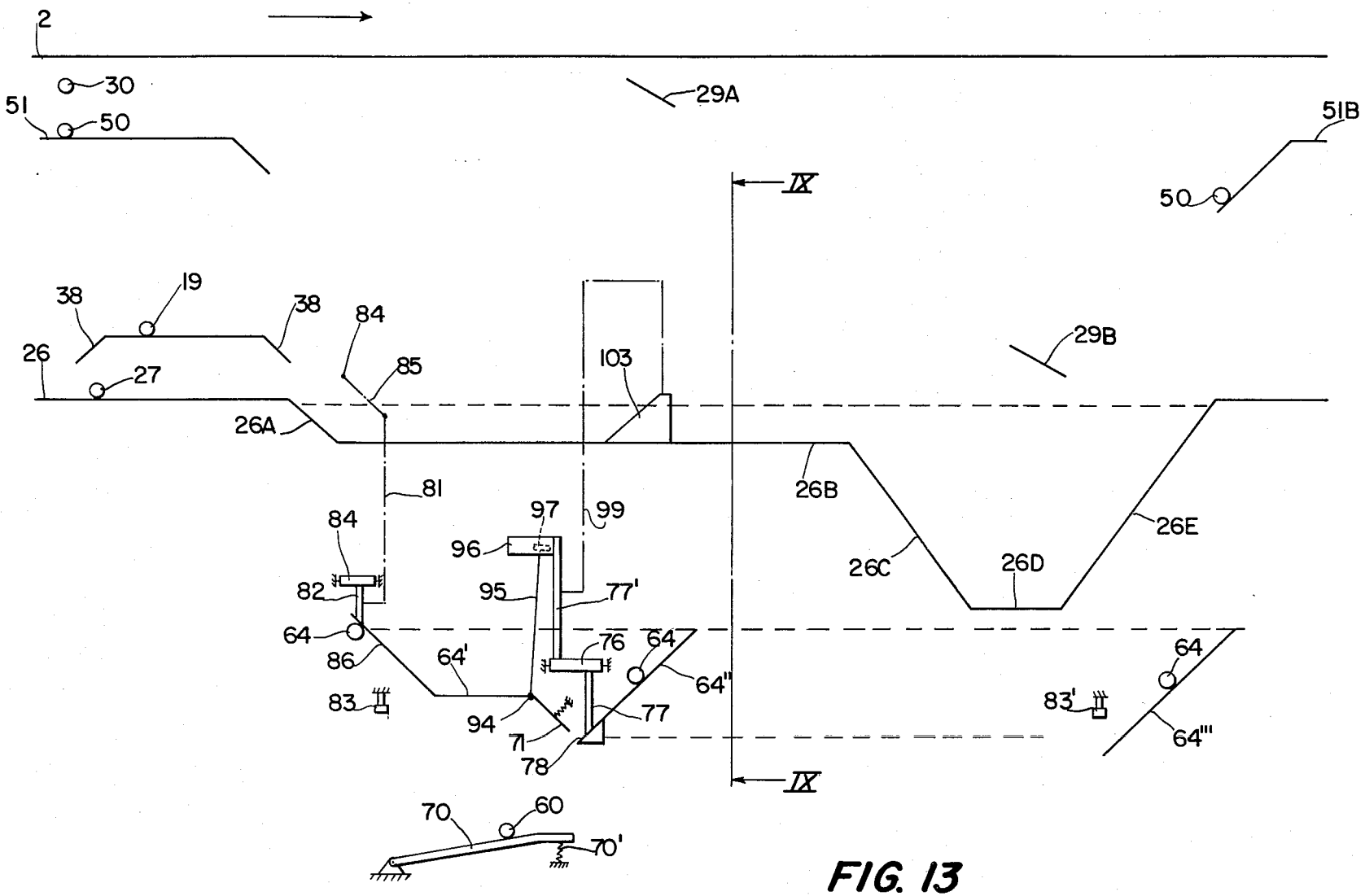

FIG. 3 corresponds to FIG. 1, but in a further position of the device;

FIG. 4 corresponds to FIG. 2, in which the device is in a further position;

FIG. 5 corresponds to FIGS. 2 and 4 with the device in an intermediate position;

FIG. 6 schematically shows in a plan view a part of the device;

FIG. 7 shows a plan view according to FIG. 6 in a further position of the device;

FIG. 8 corresponds to FIG. 7, but shows the case in which the container is not completely closed;

FIG. 9 shows details of a control device which is mounted along the track along which the device according to the preceding figures moves;

FIGS. 10, 11 and 12 show a detail of the device according to FIG. 2 in successive positions; and FIG. 13 shows diagramatically the control guides and other control devices mounted along the track.

In the drawings reference 1 is a frame which by means of pulleys can move along a fixed track 2 and 2' in the direction of arrow 3. The frame 1 has vertical rails 4 along which by means of rolls 5 a sub frame 6 can move vertically.

To the frame 1 a sheet 8 is mounted having slits 9. Feelers 11 are pivotable about pivots 10 and springs 12 urge them in the position indicated in FIG. 1 by uninterrupted lines, in which position their upper ends are located below abutments 7 of sub frame 6. Pivot mountings 16 connected to the sheet 8 support a control sheet 17 which bears a follower roll 19, which can cooperate with a control guide 38. The control sheet 17 is provided with converging edges 39 which can be put in engagement with the feelers 11 to urge them in the position indicated by interrupted lines if the follower roll 19 is lifted by the shape of the guide 38.

The sub frame 6 supports a bar 13 having at its lower end pivotable claws 14, 15 for receiving the knee-joints of a poultry. The bar 13 is pivotable about the axis of a shaft 21 which is fixedly mounted in the sub frame 6. The bar 13 is further provided with a follower roll 23 which runs in a slot 24, which has been formed in a sheet 25 which is fixedly connected to the frame 1.

The sub frame 6 is supported by means of a support roll 27 which rests on a control guide 26. For controlling the opening and closing movements of the claw parts 14 and 15 a control guide 29 is present which by means of a follower roll 30 controls the angular position of the angle arm 31, 32 which is pivoted about the axis of shaft 33 and by means of link 34 controls an arm 35, which is connected to a plate segment 20, in which non-illustrated control slots are present in which guide taps protrude which by means of non-illustrated pivotable rods inside part 13 are connected to the pivotable claw parts 14, 15, so that, if the control guide 29 declines downwardly the plate segment 20 is rotated counterclockwise (as viewed in FIG. 2) and the claw parts 14, 15 of the claw are pivoted towards their open positions.

Further, the bar 13 is provided with a clamping member 37 which is connected to a rod mounted within the bar 13, a ratchet 43 being connected to that rod, which ratchet by means of a control link 46 is connected to a frame 49 which is pivotable about the axis of shaft 21 and at its end is provided with a follower roll 50 which runs on a control guide 51. If the control guide 51 ends or declines downwards, the clamping member 37 can move downwardly until it engages the knee-joints of the poultry object, after which the ratchet 43 engages the teeth of a rack 44 which is fixedly connected to the bar 13. In this manner the clamping member 37 can take a position with respect to the claw parts 14, 15, that is adapted to the dimensions of the knee-joints.

As indicated in FIG. 5, along the track 2, 2' a fixedly mounted pivot shaft 84 is provided with an arm 85 being pivotably mounted to said shaft and having at its end a cam surface 89 which can cooperate with the follower roll 27. To the arm 85 a link 81 is connected, which is further connected to an arm 82 pivotable about a fixed pivot 84' which at its end is provided with an oblique cam surface 86.

The device, as described thus far, is adapted for use with any poultry handling apparatus in which the poultry is suspended by its knee-joints. The modelling apparatus proper, to which the invention relates, has schematically been indicated by the number 28 and is further described with reference to FIGS. 6–12.

In FIG. 6 reference 52 indicates a shell member, which at its ends by means of hinges 53 supports further shell members 54. The shell member 52 and the hinges 53 have a fixed position with respect to the frame 1. The shell member 52 has a cross-sectional shape which approximately is parabolic, whereas the shell members 54 are circular cylindrical segments. The shell members 54 each support an arm 55 which each has a follower roll 56.

Further flaps 58 are pivotably mounted to shafts 57 connected to frame 1, which flaps, because of their function, as described below, will be referred to as wing catch flaps. They support arms 59 which are provided with follower rolls 60. Arms 61, which are fixedly connected to the wing catch flaps 58 have at their ends support follower rolls 62. The wing catch flaps 58 have a circular cylindrical shape.

A control slide 63 is horizontally movable with respect to frame 1 and can be horizontally displaced by a follower roll 64 under the control of a guide 64'. The control slide is guided by guide rolls 65 and has two legs 66, the inner sides of the legs 66 being provided with recesses 67 in which the follower rolls 62 are located in the starting position of FIG. 6. Adjoining to the recesses 67 the inner edges of the legs 66 form guide surfaces for the follower rolls 62.

The follower rolls 56 in the position of FIG. 6 engages the guide surfaces 68' which have at their upper sides adjoining recesses 68.

The closing movement of the wing catch flaps 58 occurs when the slide 63 moves from the position of FIG. 6 to that of FIG. 7. Then the arms 61 are pivoted under influence of follower rolls 62 and this action pivots the wing catch flaps 58 inwardly. This movement sustains until the follower rolls 62 leave the recesses 67 and engage the inner sides of the legs 66 by reason of which moving back of the wing catch flaps 58 is prevented.

The movement of the control guide 63 occurs because the follower roll 64 engages the control guide 64' by reason of which the slide moves forwardly, that is in FIG. 6 and 7 downwardly. If the position is then obtained at which the wing catch flaps 58 are almost closed, the follower rolls 60 engage a further control guide 70 and the flaps are further closed.

The protrusions 69 adjoining the recesses 68 in the meantime engage the follower rolls 56 which are thus urged into the recesses 68, by reason of which the shell members 54 pivot. Therewith the end edges of the shell members 54 move close to the hollow inner sides of the wing catch flaps 58, so that no parts of the poultry are left outside the tube formed by shell members 52 and 54.

The working of the device is such that if the poultry object has irregular or far protruding wings, these are moved inwardly by the wing catch flaps 58 until these flaps are in their end position. After this the shell members 54 move from the position of FIG. 6 towards that of FIG. 7 and take the wings along. The result is that the wings, if possible they initially protruded in an irregular way are well applied against the body of the poultry to be modelled.

Referring again to FIGS. 6 and 7 a member 73 has been indicated, which can pivot about pivot points 72 which are fixedly connected to a sheet 88 of frame 1. In the position of FIG. 6, 73 is located with its transverse arm 74 in front of a rib 75 upstanding on the guide 63. 73 can be lifted with means still to be described, to move above this rib. In the position in which the slide 63 has been completely moved forwards (in the drawing downwards, i.e. in FIGS. 6 and 7) the projection on 73 falls behind this rib and therefore locks the shell members in the position shown in FIG. 7.

The poultry object is moved downwardly by the claw parts 14, 15 after the clamping member 37 has been moved downwards, first towards the shell member 52. The control of the wing catch flaps 58 and the further shell members 54 are then put in action. When the latter have been closed the bar 13 with its claw parts 14, 15 moves further downwards and bring the poultry to a packing device located therebelow.

After the member 73 has been lifted, the slide 63 can again be brought from the position of FIG. 7 to that of FIG. 6 by a suitable shape of the control guide 64'.

In the drawing the control guide 70 is shown by means of springs 70'. This is related to the fact that the thickness or bulkyness of the poultry object is not always the same. If a poultry object is too thick or bulky the tube members 52, 54 will not close completely, so that the protrusion on member 73 will not fall behind the rib 75. Consequently, if it is desired to drop such an oversized poultry object at a separate location, this can be done without the need to cancel the locking action of the member 73.

In FIG. 8 the case has been indicated in which the further shell members 54 are not completely closed and also the wing catch flaps 58 have not completely reached their final position. This is possible because the control guide 70 is supported by means of a spring 70' and consequently can yield. Also, a hinged part 71 of guide 64' (see FIG. 13) has been elastically mounted and can pivot around the pivot point 94 under the influence of the follower roll 64. Referring to FIGS. 9 and 13 a member 77 pivotable about a shaft 76 has a cam surface 78 for the follower roll 64. An arm 95 which, together with the guide 71 is pivotable about the pivot 94, supports a control roll 97, which can cooperate with a cam surface of the member 96 which, by means of an arm 77', is connected to the shaft 76 having an arm 77 supporting the cam surface 78. The arm 77' is further connected at 98 and via rod 99 to a cam surface 103 which is positioned in the track of follower roll 27 when the shaft 76 is pivoted by roll 97.

When normal closing and locking of the shell members has occurred (position of FIG. 7, also indicated with interrupted lines in FIG. 8), the cam surface 103 does not come into the path of roll 27. Moreover the cam surface 78 is not brought into the path of follower roll 64 because the pivotable shaft 76 is not pivoted. If, however, no locking occurs and roll 97 pivots shaft 76, the cam surface 78 comes into the path of the follower roll 64, by reason of which this follower roll is displaced by the cam surface 78 and comes to the position in which it cooperates with the control guide 64'', which means that the slide 63 moves back towards its initial position indicated in FIG. 6, so that the further shell members 54 and the wing catch flaps 58 open again. Because also the cam surface 103 is active the follower roll 27 moves the sub frame 6 upwards by reason of which the follower roll 30 engages a control guide 29A and via 31, 32, 33, 34, 35, 20 and 18 pivots the claws 14, 15 towards their open positions, so that the poultry is dropped, which means that a poultry object which was too large can be dropped at a suitable location.

With normal operation of the device the locking of the slide 63 is maintained and the poultry object can be pushed through the tube 52, 54 by the claws 14, 15 and is supplied to a packing device located therebelow.

The operation of the described device is summarized below with reference to FIG. 13. If the device in FIG. 13 moves from left to right along the guides, first the guide 38 raises roll 19 so that the feelers 11 assume the position indicated in FIG. 1 by interrupted lines. In this position the knee-joints of a poultry object can be suspended in the claws 14, 15. When the guide 38 again declines downward the knee-joints prevent the feelers 11 from moving out below the abutments 7.

In the downwardly oriented part 26A of the guide 26 of the sub frame 6 will move downwards in the normal case with two knee-joints present. However, if the sub frame 6 has not been moved downwardly, for example if one or both knee-joints are not present, the roll 27 lifts the arm 85 so that the arm 82 is pivoted, such that the follower roll 64 does not cooperate with the guide 64'. This means that the modelling apparatus is not activated and remains in its closed position.

If, however, two knee-joints are present and consequently the sub frame 6 is moved downwards at 26A, the roll 64 cooperates with the guide 64', which causes a forward sliding movement of the slide 63, so that the modelling tube 52, 54 closes. If this occurs in the normal way the roll 64 moves along the elastically mounted guide part 71 without pushing it away, by reason of which the modelling apparatus is locked in the normal way. The roll 64 does not engage the cam surface 78 and the modelling apparatus in the locked position comes to the reach of the guide track 26C, in which the poultry object is pushed through the tubes 52, 54 whereas above the part 26D by means of the guide 29B the normal discharge of a normal modelled poultry object occurs. Following this the fixed abutment 83' is active by reason of which the projection on member 73 is lifted and the modelling apparatus 52, 54 is unlocked, after which the roll 64 on the guide 64'' moves back towards its initial position.

In the beginning of the movement, before the part 26A of the guide 26 begins, the guide 51 declines downwards and finally ends, by reason of which the clamping member 37 is lowered and the ratchet 43 engages the rack 44. At the end of the whole operation the roll 50 runs on the guide 51B by reason of which the ratchet is pivoted counter-clockwise (as viewed in FIG. 2) and out of engagement with the rack 44 and is returned to its initial position.

In the case in which the poultry is too thick the resiliency of spring 70' will prevent a complete closure of the tube 52, 54, and the guide 71 will pivot the arm 95, by reason of which the roll 97 of the member 76 is pivoted. This has two results. Firstly the cam surface 103 is put into the track of roll 27 by the schematically indicated connection 99, by reason of which that roll moves upwardly. Additionally, the roll 30 engages the declining control guide 29A, so that the device discharges, which allows the feelers 11 to locate themselves below the abutments 7, so that the sub frame 6 beyond the end of the control surface 103 is supported by the feelers.

Only at the end of the rising part of guide 26E is the sub frame 6 completely back to its initial level.

However the movement of the shaft 76 has also put the cam surface 78 into the track of roll 64 by reason of which it cooperates with the guide 64''. Because the modelling apparatus has not been locked it will partly open again, which requires that after discharge of the claws 14, 15 caused by guide 29A the poultry will be dropped quickly and undisturbed.

We claim:

1. A device for modelling or packing an object comprising a container which is closable about said object, driving means for moving the container from a first position in which it has a first circumferential shape towards a second position in which it has a second circumferential shape which has a cross-sectional area smaller than the cross-sectional area of the first circumferential shape, and said driving means including elastic means for resiliently moving the container from said first position to said second position to hold the container as far as an over-sized object will permit it to move towards the second position, even if it has not moved all the way to the said second position.

2. A device according to claim 1, including discharge means responsive to the position of the container after it has been moved from the first position as far as it can be moved towards the second position, for discharging the object when the container has not reached its said second position.

3. A device according to claim 1, in which the container is a modelling tube for poultry which can be opened and closed.

4. A device according to claim 1, said driving means including an endless track for moving the device along a path, control guides positioned along said path, and said device including follower members which cooperate with the control guides to effect operation of the device.

5. A device according to claim 4, in which at least one control guide includes an elastic mounting permitting it to yield when engaged by a follower member of the device.

6. A device according to claim 5, wherein the follower member which engages the elastically mounted control guide is the follower member which causes movement of the container from said second position to said first position.

7. A device according to claim 4, including locking means for locking the container in said second position, and including control members operable in response to whether or not the container has been locked in said second position for causing a follower member to cooperate or not cooperate with its control guide.

8. A device according to claim 7, including movable guide members, the position of which determine whether a follower member does or does not cooperate with a certain control guide.

9. A device according to claim 4, said control guides including a first control guide with a downwardly declining part, a horizontal part, a further downwardly declining part, a further horizontal part and an upwardly inclined part, and a follower member cooperating with this control guide, a second control guide in the region of said horizontal part and a third control guide in the region of said further horizontal part, said control guides cooperating with a discharge mechanism, means in the region of said horizontal part for causing the discharge mechanism to operate in response to less than complete movement of the container to the second position.

10. A device according to claim 9, including blocking means for preventing the device from moving along the guide track, said blocking means being operable to keep the device in its highest position in which a follower member of the device can cooperate with said third control guide to operate the discharge mechanism.

11. A device according to claim 10, including a switch mechanism arranged to be activated by movement of the device along said track in order to prevent closing of the container if the blocking means is active and to define the height position of the device, by preventing the follower member from coming into the track of the related control guide.

12. A device according to claim 7, including abutments fixedly mounted along the track for unlocking the locking means.

* * * * *

UNITED STATES PATENT AND TRADEMARK OFFICE

CERTIFICATE OF CORRECTION

PATENT NO. : 4,257,141

DATED : March 24, 1981

INVENTOR(S) : Johannes van Brummelen

It is certified that error appears in the above-identified patent and that said Letters Patent are hereby corrected as shown below:

On the title page the names of inventors should read

--[75] Inventor: Mannes Van Ginkel and
Jan Plug, both of Barneveld, Netherlands. --.

Signed and Sealed this

Second Day of June 1981

[SEAL]

Attest:

RENE D. TEGTMEYER

Attesting Officer

Acting Commissioner of Patents and Trademarks